US010154349B2

(12) United States Patent
Li et al.

(10) Patent No.: US 10,154,349 B2
(45) Date of Patent: Dec. 11, 2018

(54) SPEAKER DEVICE

(71) Applicant: GOERTEK INC., WeiFang, Shandong (CN)

(72) Inventors: Shugang Li, WeiFang (CN); Xiaodong Cai, WeiFang (CN); Cheng Zhang, WeiFang (CN)

(73) Assignee: Goertek Inc., WeiFeng (CN)

( * ) Notice: Subject to any disclaimer, the term of this patent is extended or adjusted under 35 U.S.C. 154(b) by 0 days.

(21) Appl. No.: 15/567,708

(22) PCT Filed: Nov. 16, 2015

(86) PCT No.: PCT/CN2015/094673

§ 371 (c)(1),
(2) Date: Oct. 19, 2017

(87) PCT Pub. No.: WO2016/169255

PCT Pub. Date: Oct. 27, 2016

(65) Prior Publication Data

US 2018/0098157 A1 Apr. 5, 2018

(30) Foreign Application Priority Data

Apr. 22, 2015 (CN) ..... 2015 1 0194262

(51) Int. Cl.
*H04R 9/06* (2006.01)
*H04R 9/02* (2006.01)
(Continued)

(52) U.S. Cl.
CPC ..... *H04R 9/06* (2013.01); *H01Q 1/44* (2013.01); *H04R 7/04* (2013.01); *H04R 7/18* (2013.01);
(Continued)

(58) Field of Classification Search
CPC ..... H04R 9/06; H04R 9/025
See application file for complete search history.

(56) References Cited

U.S. PATENT DOCUMENTS

2013/0278364 A1* 10/2013 Slotte ..... H04R 9/00 335/209
2014/0104113 A1* 4/2014 Miyagawa ..... H01Q 1/243 343/700 MS

FOREIGN PATENT DOCUMENTS

CN 202695703 U 1/2013
CN 204231664 U 3/2015
(Continued)

OTHER PUBLICATIONS

International Search Report and Written Opinion, dated Jan. 26, 2016, State Intellectual Property Office of the P.R. China.

*Primary Examiner* — Tuan D Nguyen
(74) *Attorney, Agent, or Firm* — Holzer Patel Drennan

(57) ABSTRACT

Disclosed is a speaker device, comprising a vibration system, a magnetic circuit system, and an auxiliary system for accommodating and fixing the magnetic circuit system and the vibration system. The vibration system comprises a diaphragm, a centering piece and a voice coil which are combined together. The centering piece comprises a first fixing portion, a second fixing portion provided therein, and a connecting arm for connecting the first the second fixing portion. The second fixing portion is provided with an antenna circuit, the first fixing portion is provided with a first external bonding pad corresponding to the antenna circuit, and the antenna circuit is electrically connected to the first external pad. The speaker device of the present invention may achieve antenna functions without increasing a thickness of the speaker device, which is advantageous to a thinner design and an integrated design of the speaker device.

9 Claims, 2 Drawing Sheets

(51) Int. Cl.

| | |
|---|---|
| ***H01Q 1/44*** | (2006.01) |
| ***H04R 7/04*** | (2006.01) |
| ***H04R 7/18*** | (2006.01) |
| *H01Q 1/38* | (2006.01) |

(52) U.S. Cl.
CPC ..... *H04R 9/025* (2013.01); *H01Q 1/38* (2013.01); *H04R 2420/07* (2013.01)

(56) References Cited

FOREIGN PATENT DOCUMENTS

| | | | |
|---|---|---|---|
| CN | 104822113 | A | 8/2015 |
| CN | 204616079 | U | 9/2015 |
| JP | 3987419 | B2 | 10/2007 |
| KR | 1341486 | B1 | 12/2013 |

* cited by examiner

SPEAKER DEVICE

TECHNICAL FIELD

The present invention relates to the field of electroacoustics, and more particularly, to a multifunctional speaker device of integrated design.

BACKGROUND ART

With the development of science and technology, portable electronic devices attract widespread attention. As a major sound producing unit of a portable electronic terminal, a speaker device directly affects the use effects of the portable electronic devices.

As the portable electronic devices become thinner, thicknesses of the speaker devices increasingly become focus of attention in this field. Meanwhile, in order to benefit thin design of the portable electronic devices, an integrated design of electronic components in the portable electronic devices becomes a design trend. How to provide a speaker with thinner design and high integral level becomes a problem the research and development person are facing.

SUMMARY

A technical problem to be solved by the present invention is to provide a speaker device with high integrated design and good thinner design.

In order to achieve the above objectives, the present invention adopts the following technical solutions.

A speaker device comprises a vibration system, a magnetic circuit system, and an auxiliary system for accommodating and fixing the magnetic circuit system and the vibration system. The vibration system comprises a diaphragm, a centering piece and a voice coil which are combined together. The centering piece comprises a first fixing portion, a second fixing portion provided in the first fixing portion, and a connecting arm for connecting the first fixing portion and the second fixing portion. The second fixing portion is provided with an antenna circuit, the first fixing portion is provided with a first external pad corresponding to the antenna circuit, and the antenna circuit is electrically connected to the first external pad.

As a preferred technical solution, the second fixing portion is provided with a second pad corresponding to the voice coil, and the voice coil is electrically connected to the second pad.

As a further preferred technical solution, the first fixing portion is provided with a second external pad, and the second pad is electrically coupled to the second external pad.

As a preferred technical solution, the centering piece is provided with a conductive circuit. Each of the first fixing portion, the second fixing portion and the connecting arm is provided with the conductive circuit.

As a preferred technical solution, the antenna circuit is a conductive metal circuit.

As a preferred technical solution, the antenna circuit is provided at the second fixing portion through laser direct structuring.

As a preferred technical solution, the antenna circuit is provided at a side, which is close to the diaphragm, of the centering piece.

As another preferred technical solution, the antenna circuit is provided at a side, which is away from the diaphragm, of the centering piece.

As a preferred technical solution, the auxiliary system comprises a front cover and a housing, and the first fixing portion of the centering piece is fixed between the front cover and the housing.

By providing an antenna circuit at a central position of the second fixing portion of the centering piece and integrating an antenna device and a sound-producing device, the speaker device of the present invention may achieve antenna functions without increasing a thickness of the speaker device and be beneficial to a thinner design of the speaker device, which are advantageous to a thinner design and an integrated design of the product. Therefore, the speaker device of the present invention has the advantage of high integrated design and good thinner design.

DETAILED DESCRIPTION OF EMBODIMENTS

Hereinafter, the present invention will be described in details with reference to the accompanying drawings.

Figure 1:
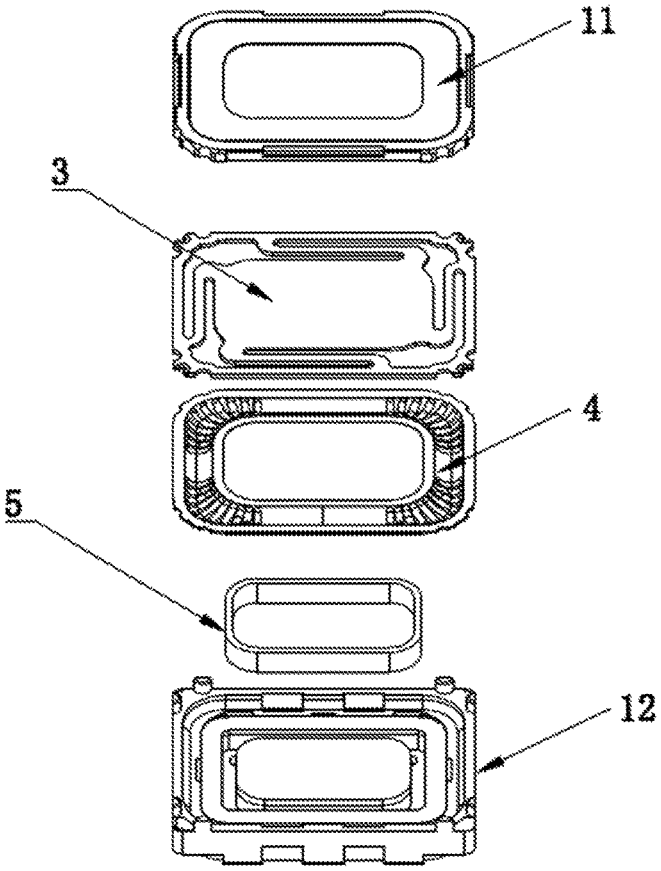
FIG. 1 is an exploded view of a speaker device according to a specific embodiment of the present invention.
Figure 2:
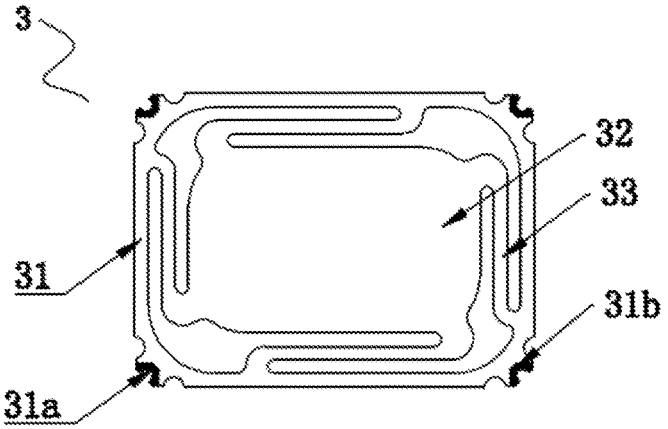
FIG. 2 is a schematic view of a centering piece as shown in FIG. 1.

As shown in FIG. 1, the speaker device according to the specific embodiment of the present invention comprises a vibration system, a magnetic circuit system and an auxiliary system. The auxiliary system comprises a front cover 11 and a housing 12. The front cover 11 and the housing 12 accommodate and fix the vibration system and the magnetic circuit system. The vibration system comprises a diaphragm 4, a centering piece 3 and a voice coil 5 which are fixedly combined with the diaphragm 4. The magnetic circuit system comprises a magnet and a magnetic conductive member. As shown in FIG. 2, the magnetic circuit system is provided with a magnetic gap, into which the voice coil 5 suspends. When an external electrical signal enters into the voice coil 5, current of the voice coil 5 positioned in the magnetic field changes, so that the voice coil 5 vibrates up and down by Lorentz force. Vibration of the voice coil 5 drives the diaphragm 4 to vibrate, and vibration of the diaphragm 4 incites air to make sounds.

Figure 3:
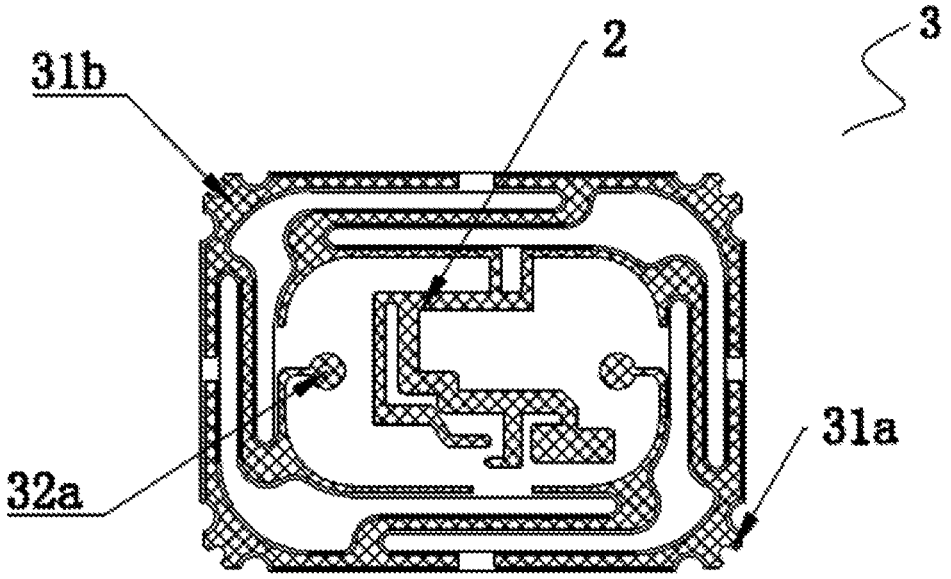
FIG. 3 is a schematic view of the other side of the centering piece as shown in FIG. 2.

As shown in FIG. 2, in the speaker device of the present invention, the centering piece 3 includes a first fixing portion 31 and a second fixing portion 32 provided in the first fixing portion 31. The second fixing portion 32 has a plane structure. The first fixing portion 31 is connected to the second fixing portion 32 through a connecting arm 33. The first fixing portion 31 is provided with a group of first external pads 31*a*. As shown in FIG. 3, the second fixing portion 32 of the speaker device of the present invention is provided with an antenna circuit 2, and the antenna circuit 2 is electrically connected to the first external pad 31*a* of the first fixing portion 31. The antenna circuit 2 is electrically coupled with an external circuit through the first external pad 31*a*, such that the speaker device of the present invention has antenna functions. The antenna circuit provided on the second fixing portion of the centering piece does not occupy space of the speaker device, which is advantageous to the thinner design of the speaker device. The antenna circuit allows the speaker device of the present invention to have functions of signal sending and receiving, which is advantageous to the integrated design of the speaker device.

Meanwhile, since the antenna circuit is provided on the centering piece of the speaker, which is disposed in the speaker, it is possible to protect the antenna circuit, prevent the antenna circuit, once being arranged outside the speaker device, from being damaged during the process of production and application of the speaker, and thereby improving the reliability of the antenna circuit.

As shown in FIG. 3, the second fixing portion 32 is provided with a group of second pads 32*a*. The second pads 32*a* are welded to the voice coil. The first fixing portion 31 is provided with a group of second external pads 31*b*, and the second external pads 31*b* are electrically coupled with the second pads 32*a*. The centering piece 3 is provided with a conductive circuit. Each of the first fixing portion 31, the second fixing portion 32 and the connecting arm 33 is provided with the conductive circuit. The external pads provided on the first fixing portion are electrically connected to the pads provided on the second fixing portion through the conductive circuits.

In the process of practical application, the antenna circuit may be a conductive metal circuit. The conductive metal circuit may be provided in the centering piece, which may be a flexible circuit board structure. The centering piece is internally provided with an antenna circuit, which equivalents to a flexible circuit board antenna. In the process of practical application, the antenna circuit also may be directly provided on a surface of the centering piece through Laser Direct Structuring (LDS). The antenna circuit may be provided at a side, being away from or close to the diaphragm, of the centering piece, according to requirement, which will not affect the advantages of the speaker device of the present invention.

As shown in FIG. 1, in the speaker device of the present invention, the auxiliary system comprises a front cover 11 and a housing 12. The first fixing portion 31 of the centering piece 3 is fixed between the front cover 11 and the housing 12. The second fixing portion 32 is accommodated in space enclosed by the front cover 11 and the housing 12. The antenna circuit provided on the second fixing portion is also accommodated between the front cover and the housing. The front cover and the housing may protect the antenna circuit from being damaged in the assembly and application processes of the speaker, and thereby ensuring proper work of the antenna circuit.

By providing an antenna circuit at a central position of the second fixing portion of the centering piece and integrating an antenna device and a sound-producing device, the speaker device of the present invention may achieve antenna functions without increasing a thickness of the speaker device and be beneficial to a thinner design of the speaker device, which are advantageous to a thinner design and an integrated design of the product.

The above are merely the embodiments of the present invention and are not intended to limit the present invention. All equivalent modifications or variations made by those of ordinary skill in the art according to the disclosure in the present invention should fall within the scope of protection defined in the claims.

What is claimed is:

1. A speaker device, comprising a vibration system, a magnetic circuit system, and an auxiliary system for accommodating and fixing the magnetic circuit system and the vibration system; the vibration system comprises a diaphragm, a centering piece and a voice coil which are combined together, the centering piece comprises a first fixing portion, a second fixing portion provided in the first fixing portion, and a connecting arm for connecting the first fixing portion and the second fixing portion; wherein the second fixing portion is provided with an antenna circuit at a central position, the first fixing portion is provided with a first external pad corresponding to the antenna circuit, and the antenna circuit is electrically connected to the first external pad, and the antenna circuit is electrically coupled with an external circuit through the first external pad.

2. The speaker device according to claim 1, wherein the second fixing portion is provided with a second pad corresponding to the voice coil, and the voice coil is electrically connected to the second pad.

3. The speaker device according to claim 2, wherein the first fixing portion is provided with a second external pad, and the second pad is electrically coupled to the second external pad.

4. The speaker device according to claim 1, wherein the centering piece is provided with a conductive circuit, and each of the first fixing portion, the second fixing portion and the connecting arm is provided with the conductive circuit.

5. The speaker device according to claim 1, wherein the antenna circuit is a conductive metal circuit.

6. The speaker device according to claim 1, wherein the antenna circuit is provided at the second fixing portion through laser direct structuring.

7. The speaker device according to claim 1, wherein the antenna circuit is provided at a side, which is close to the diaphragm, of the centering piece.

8. The speaker device according to claim 1, wherein the antenna circuit is provided at a side, which is away from the diaphragm, of the centering piece.

9. The speaker device according to claim 1, wherein the auxiliary system comprises a front cover and a housing, and the first fixing portion of the centering piece is fixed between the front cover and the housing.

* * * * *